US009865940B2

(12) United States Patent
Sichmann et al.

(10) Patent No.: US 9,865,940 B2
(45) Date of Patent: Jan. 9, 2018

(54) DIRECT PLUG-IN COMPRESSION SPRING TERMINAL WITH RETAINING SPRING

(71) Applicant: Weidmüller Interface GmbH & Co. KG, Detmold (DE)

(72) Inventors: Wolfgang Sichmann, Hüttenberg (DE); Matthias Krug, Ruhla (DE)

(73) Assignee: Weidmüller Interface GmbH & Co. KG (DE)

( * ) Notice: Subject to any disclaimer, the term of this patent is extended or adjusted under 35 U.S.C. 154(b) by 0 days.

(21) Appl. No.: 15/308,264

(22) PCT Filed: May 11, 2015

(86) PCT No.: PCT/EP2015/060315
§ 371 (c)(1),
(2) Date: Nov. 1, 2016

(87) PCT Pub. No.: WO2015/180950
PCT Pub. Date: Dec. 3, 2015

(65) Prior Publication Data

US 2017/0077620 A1 Mar. 16, 2017

(30) Foreign Application Priority Data

May 28, 2014 (DE) ..... 20 2014 102 521 U

(51) Int. Cl.
*H01R 4/48* (2006.01)

(52) U.S. Cl.
CPC ..... *H01R 4/4836* (2013.01)

(58) Field of Classification Search
CPC .. H01R 4/4818; H01R 4/4836; H01R 4/4827; H01R 4/4845; H01R 12/515
See application file for complete search history.

(56) References Cited

U.S. PATENT DOCUMENTS 7,238,043 B2 * 7/2007 Reibke ..... H01R 4/4827 439/441
7,287,999 B2 * 10/2007 Holterhoff ..... H01R 4/4836 439/441

(Continued)

FOREIGN PATENT DOCUMENTS

DE 3302372 C2 7/1984
DE 20108417 U1 8/2001

(Continued)

*Primary Examiner* — Xuong Chung Trans
(74) *Attorney, Agent, or Firm* — Laubscher, Spendlove & Spendlove, P.C.

(57) ABSTRACT

A direct plug-in compression spring terminal includes a bus bar for contacting an electrical conductor, and a clamping spring for fastening the electrical conductor in the direct plug-in compression spring terminal, wherein the clamping spring has a clamping arm that can be pivoted in a clamping direction about a clamping axis, and an actuating device for pivoting the clamping bar. In an open state, in which the electrical conductor can be inserted into the direct plug-in compression spring terminal, the clamping arm is pivoted against the clamping direction against a restoring force of the clamping spring. In a clamping state, in which the electrical conductor is clamping in the direct plug-in compression spring terminal, the clamping arm is pivoted in the clamping direction by the restoring force of the clamping spring. In the open state, the actuating device is locked in the direct plug-in compression spring terminal and additionally clamped to the clamping arm.

5 Claims, 5 Drawing Sheets

(56) References Cited

U.S. PATENT DOCUMENTS

| | | | | |
|---|---|---|---|---|
| 8,251,738 | B2 * | 8/2012 | Heckert | H01R 4/4836<br>439/441 |
| 9,466,911 | B1 * | 10/2016 | Wu | H01R 4/4836 |

FOREIGN PATENT DOCUMENTS

| | | | |
|---|---|---|---|
| DE | 202006009460 | U1 | 3/2007 |
| DE | 102007050683 | B4 | 9/2009 |
| DE | 102008039232 | A1 | 2/2010 |
| DE | 202008014469 | U1 | 3/2010 |
| DE | 102011012021 | A1 | 8/2012 |
| DE | 202011050916 | U1 | 11/2012 |

* cited by examiner

DIRECT PLUG-IN COMPRESSION SPRING TERMINAL WITH RETAINING SPRING

CROSS-REFERENCE TO RELATED APPLICATIONS

This application is a national stage application under 35 U.S.C. §371 of the PCT International Application No. PCT/EP2015/060315 filed May 11, 2015, which claims priority of the German application No. DE202014102521.9 filed May 28, 2014. The entire content of these applications is herein incorporated by reference.

BACKGROUND OF THE INVENTION

Direct plug-in terminals are known and have various configurations and features. Depending on their particular use and their inclusion conditions, they differ especially in the current-carrying capacity of the bus bar, the spring force of the retaining spring and/or their construction shape and construction size. A simple assembly and an economical manufacture are essential requirements for such a terminal.

In addition, depending on where the terminals are use, reliability in an environment subject to heavy vibrations is essential.

The subject matter of the application was developed to provide a direct plug-in compression spring terminal which ensures an easy assembly of electrical conductors in an environment subject to heavy vibrations.

SUMMARY OF THE INVENTION

A spring-force clamp includes a bus bar for contacting an electrical conductor and which a clamping spring with a clamping arm which can be introduced from a clamping state in which the clamping arm presses the electrical conductor against the bus bar into an open state in which the electrical conductor can be introduced into the direct plug-in compression spring terminal. The direct plug-in compression spring terminal can be pivoted about a clamping axis in a clamping direction and includes an actuation device which is arranged so that it can shift in a shifting direction for pivoting the clamping arm from the clamping state into the open state.

The direct plug-in compression spring terminal includes a catch on the actuation device and a counter-catch on the direct plug-in compression spring terminal which engage with one another in the open state, wherein the clamping arm clamps the actuation device in the open state at an angle greater than 0° in order to shift it into a catch position.

The actuation device is therefore not only locked in the open state, in which the electrical conductor can be introduced into the direct plug-in compression spring terminal but rather it is clamped in addition in this state by the clamping arm in a locked position. As a consequence, it is not detached from this locked position even in a heavy vibration environment. Therefore, if the direct plug-in compression spring terminal is in the open state, the electrical conductor can be readily introduced into the direct plug-in compression spring terminal even under the stress of heavy vibrations.

\In order to clamp the activation device, a clamping force of the clamping spring is used. In an especially preferred manner, the clamping arm presses the activation device with the clamping force of the clamping spring into the locked position.

In a further preferred manner, the actuation device rests in the open state on the contact point in the sense of a type of contact shaft of the direct plug-in compression spring terminal, which shaft is arranged on the direct plug-in compression spring terminal on a side of the activation device which is opposite the counter-catch. The contact point is therefore at a distance from the counter-catch. As a result, a lever action which amplifies the clamping force of the spring is utilized. The actuation device is therefore clamped very securely in the locked position.

In order for the locked position of the actuation means to be at an angle greater than 0° relative to the shifting direction, it is preferred that a diameter of a second introductory opening in which the activation device is arranged is greater than a diameter of the activation device.

The clamping arm can preferably be adjusted against the shifting direction from the open state into the clamped state by shifting the activation device.

The activation device is preferably provided in such a manner that it can pivot about the contact point into an unlocking direction. It can preferably be unlocked by pressing the activation device in a pressing direction transverse to the shifting direction into an unlocked position, during which the catch and the counter-catch move out of engagement with one another.

It is preferred that the activation device is provided in such a manner that it can shift in the unlocked position and counter to the shifting direction. It is especially preferred that the activation device is shifted in the unlocked position with the force of the clamping spring against the shifting direction. Since the clamping spring supports shifting against the shifting direction with its clamping force, adjustment of the clamping arm from the open state into the clamping state for the assembler can be carried out in a simple and rapid manner. Therefore, in the case of a conductor inserted into the direct plug-in compression spring terminal, the latter can be clamped in a very rapid and simple manner.

In order to prevent a removal or falling out of the activation device from the direct plug-in compression spring terminal, the latter preferably additionally includes a securing device which cooperates with a counter-securing device of the direct plug-in compression spring terminal. The securing device and the counter-securing device preferably come into contact with one another during shifting of the activation device counter to the shifting direction. As a consequence, the activation device is shifted into a secure position in which it can no longer be shifted against the shifting direction.

In a preferred embodiment, the securing device is constructed as a bent contour, wherein the counter-securing device is constructed as a bent counter-contour. In this embodiment the activation device can be shifted back into the unlocked position only by shifting into the shifting direction. However, even other securing devices, for example catch contours, can be used as securing and counter-securing devices.

The direct plug-in compression spring terminal can also be operated under a load of heavy vibrations.

BRIEF DESCRIPTION OF THE FIGURES

The invention is described in the following figures. The figures are only exemplary and do not limit the general concept of the invention.

FIG. 1(*b*) is a partial sectional view of the compression spring terminal with the clamping arm in an open state;

FIG. 1(*c*) is a partial sectional view of the compression spring terminal with an electrical conductor arranged therein;

FIG. 1(*d*) is a is a partial section view of the compression spring terminal and electrical conductor during unlocking of the activation device; and FIG. 1(*e*) is a partial sectional view showing the compression spring terminal and electrical conductor with the clamping arm in a clamping state.

DETAILED DESCRIPTION

Figure 1A:
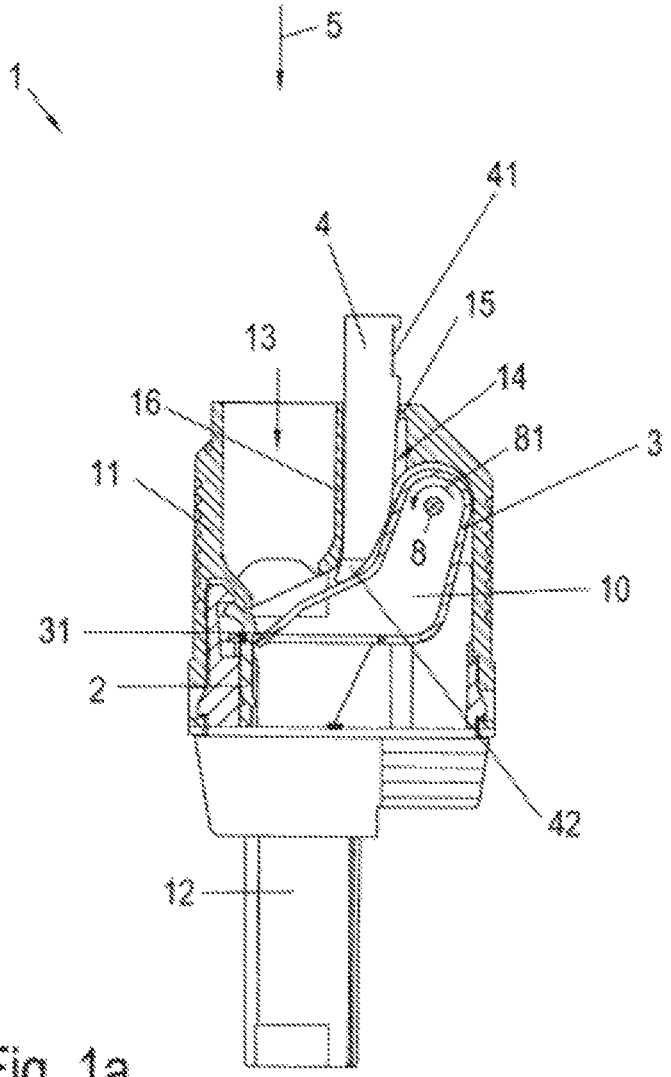
FIG. 1(*a*) is a partial sectional view showing a compression spring terminal with a clamping arm for claiming an electrical conductor.
Figure 1B:
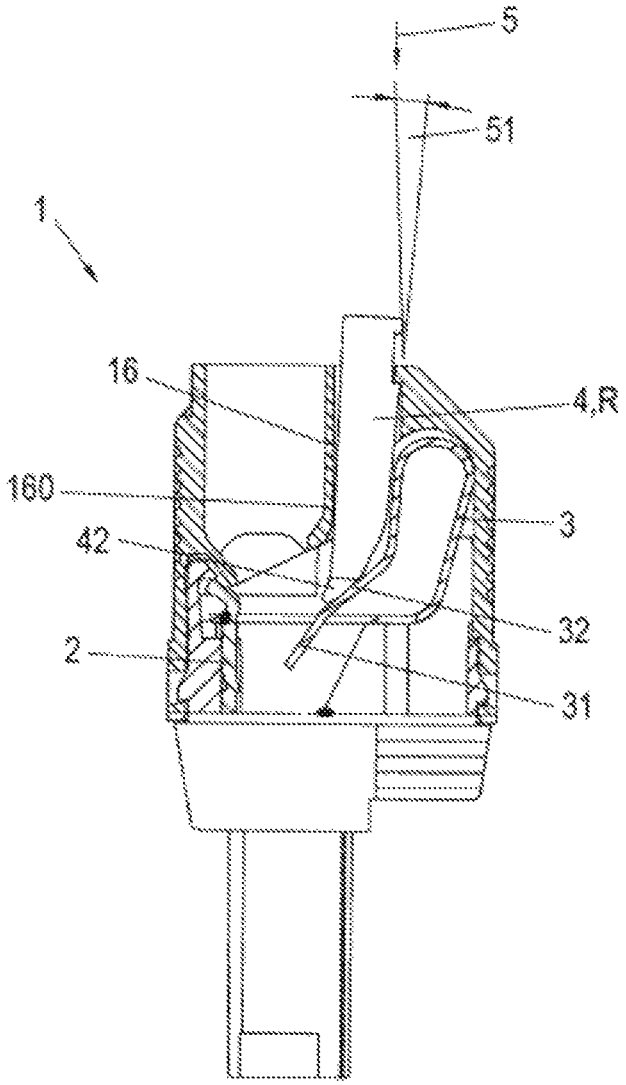
Figure 1C:
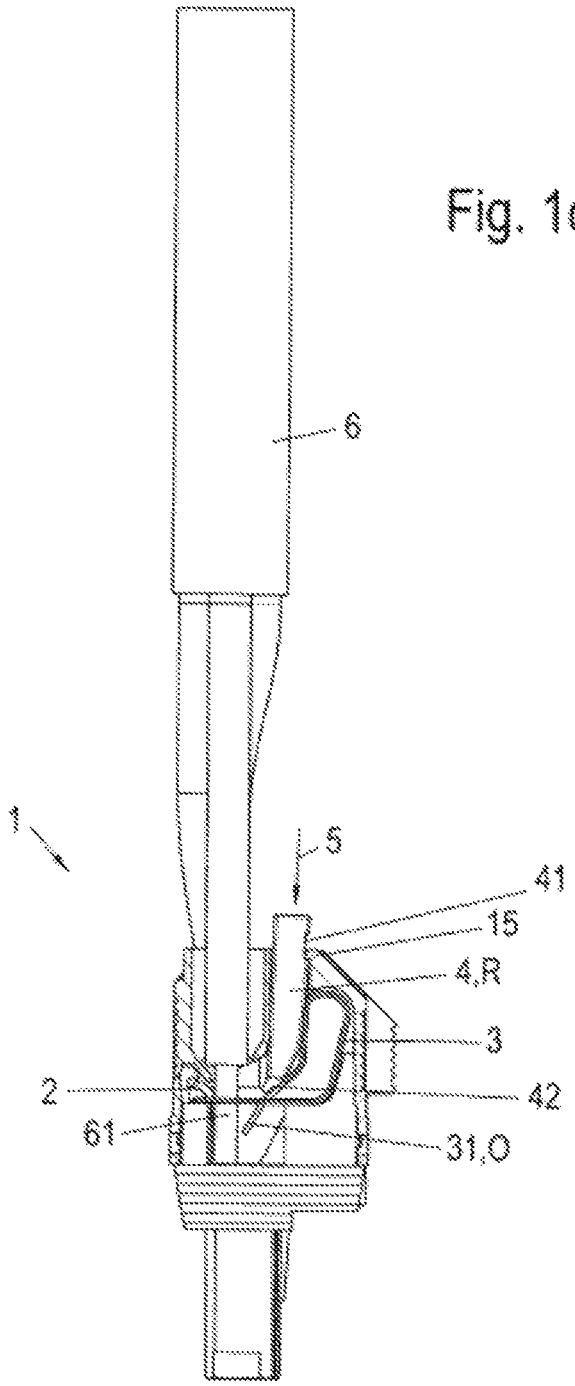
Figure 1D:
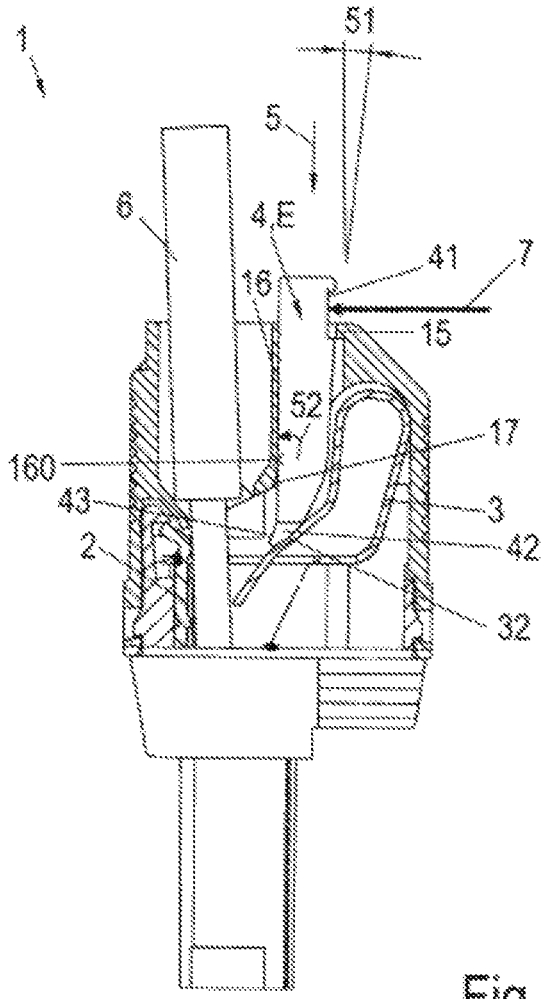
Figure 1E:
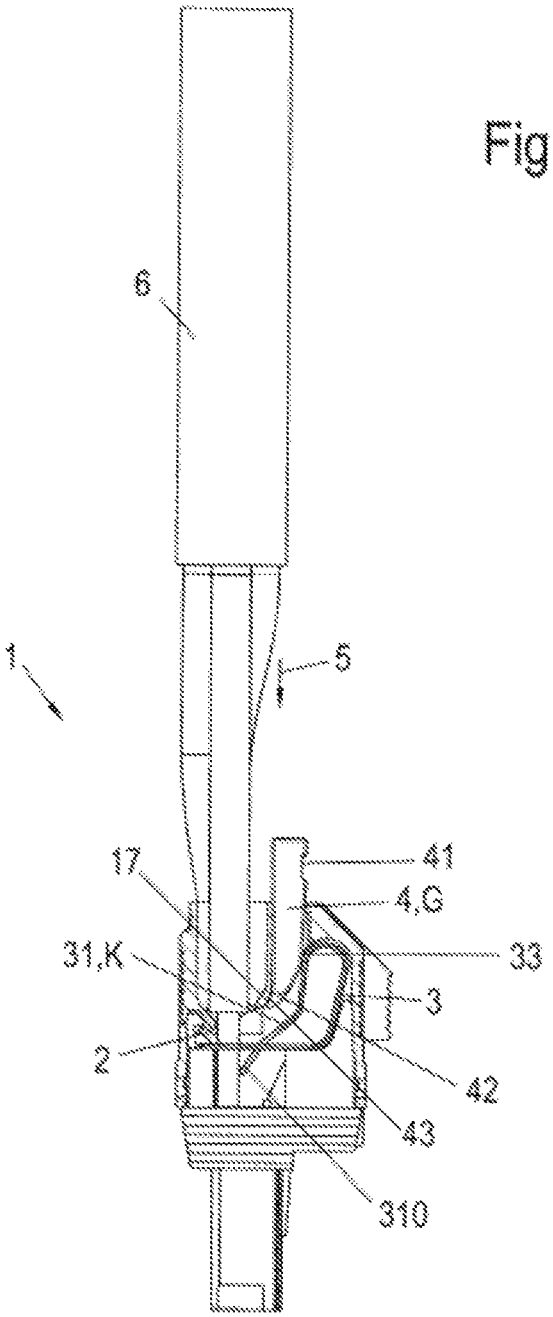

FIGS. 1(*a*) and 1(*b*) show a compression spring terminal and more particularly a direct plug-in compression spring terminal 1 for connecting a bus bar with the end of a conductor (not shown).

The direct plug-in compression spring terminal 1 has a housing 11 which defines an inner space or cavity 10. A bus bar 2 is arranged in the inner space 10 which makes electrical contact with an electrical connection pin 12 of the direct plug-in compression spring terminal 1. The electrical connection pin 12 is provided for electrically connecting an electrical structural group (not shown) or an electrical structural component (not shown) to the direct plug-in compression spring terminal 1.

A clamping spring 3 is arranged in the inner space 10 for clamping an electrical conductor 6 in the direct plug-in compression spring terminal 1 as shown in FIGS. 1(*c*)-(*e*). The clamping spring 3 includes a clamping arm 31 which can pivot about a clamping axis 8 normal to a clamping direction 81. The clamping arm 31 can pivot from an open state O into a clamping state K as shown in FIGS. 1(*d*) and 1(*e*).

A conductor introduction opening 13 is provided in the housing 11. In the open state O, the inner space 10 is accessible from the outside through the conductor introduction opening 13. In this state O the clamping arm 31 is pivoted counter to its return force against the clamping direction 81. As a result, the electrical conductor 6 can be pushed in the open state O through the conductor introduction opening 13 into the inner space 10.

In the clamping state K, the clamping arm 31 is pivoted with its return force of the clamping spring 3 in the clamping direction 81. When an electrical conductor 6 (see FIG. 1(*e*)) is pushed in the conductor introduction opening 13 and into the inner space 10, the conductor is therefore clamped in the clamping state K with the return force of the clamping spring 3.

A bus bar 2 is arranged on a side of the inner space 10 opposite the clamping arm 31. In the clamping state K, the electrical conductor 6 is therefore pressed by the return force of the clamping spring 31 against the bus bar 2. As a result, the electrical conductor 6 makes an electrically conductive contact with the connection pin 12 in the clamping state K.

A second introduction opening 14 for an activation device 4 is provided in the housing 11. An activation device or actuator 4 is arranged in the second introduction opening 14 and is displaceable in a shifting direction 5 and in a direction opposite to the shifting direction.

In the embodiment shown, the conductor introduction opening 13 and the second conductor introduction opening 14 are arranged parallel to one another. However, an embodiment of the direct plug-in compression spring terminal 1 is also conceivable in which the conductor introduction 13 and the second introduction opening 14 are arranged at a different angle (not shown) to one another, in particular in order to take into account the conditions of the direct plug-in compression spring terminal 1 and its accessibility for an assembler.

The activation device 4 is provided for fixing the clamping arm 31 in the open state O. As a result, the clamping arm does not pivot automatically from the open state O into the clamping state K even under a heavy vibration load.

The activation device 4 includes a catch portion 41 which cooperates with a counter-catch or projection 15 of the direct plug-in compression spring terminal 1. The counter-catch 15 is arranged on the housing of the direct plug-in compression spring terminal 1.

The catch portion 41 is constructed as a recess, in particular as a groove. The counter-catch 15 is constructed as a web or projection. However, an inverted arrangement is also possible with a catch constructed as a projection on the actuator and with a counter-catch constructed as the recess (not shown) within the terminal housing.

In the open state O, the catch portion 41 and the counter-catch 15 are engaged or locked to one another. In addition, the activation device 4 in the open state O clamps at an angle 51 greater than 0° relative to the shifting direction 5 with the clamping arm 31 in a catch position R. The clamping force of the clamping spring 3 is utilized so that the catch portion 41 and the counter-catch 15 are not unlocked even under a heavy vibration load.

In the catch position R, the activation device 4 lies in the open state O on a contact point of the housing 11. The contact point 160 is arranged on a side of the activation device 4 on the direct plug-in compression spring terminal 1 opposite the counter-catch 15, in particular on a wall 16 formed by the housing 11 between the conductor introduction opening 13 and the second introduction opening 14. In the open state, the activation device 4 can pivot about the contact point 160 into an unlocking direction 52. The catch portion 41 and the counter-catch 15 can be unlocked from one another by pivoting the activation device 4.

The activation device 4 is pressed into a pressing direction 7 transverse to the shifting direction 5, during which it is moved from the catch position R into an unlocked position E.

In the unlocked position E, the activation device 4 can be displaced in the shifting direction 5 and in a direction opposite to the shifting direction. Since the clamping arm 31 rests in the clamping position R on the activation device 4 and presses the latter with its clamping force opposite to the shifting direction 5, the activation device 4 is also pressed in the unlocked position E by the clamping force opposite to the shifting direction 5. The clamping arm 31 is moved opposite to the shifting direction 5 from the open state O into the clamping state K until it rests either on the bus bar 2 or on an electrical conductor 6 introduced into the direct plug-in compression spring terminal 1. When a conductor 6 is inserted into the direct plug-in compression spring terminal 1, it is securely clamped.

In order to prevent the activation device 4 from falling out of the direct plug-in compression spring terminal 1, the activation device 4 also has a curved contour which serves as a securing device 43. Upon further shifting of the activation device 4 in a direction opposite to the shifting direction 5, the curved contour comes in contact with a bent or curved counter-contour 17 which acts as a counter-securing device 43 of the direct plug-in compression spring terminal 1. In this secured position G, the actuation device 4 cannot be displaced further in a direction opposite to the shifting direction 5.

In order to introduce an electrical conductor 6 into the direct plug-in compression spring terminal 1, the clamping arm 31 is moved into the open state O by shifting the actuation device 4 in the shifting direction 5, at which time the actuation device 4 assumes a catch position R in which the catch 41 and the counter-catch 15 are engaged with one another. As a consequence, the inner space 10 is accessible through the conductor introduction opening 13 for the electrical conductor 6.

The electrical conductor 6 is then inserted through the conductor introduction opening 13 into the direct plug-in compression spring terminal 1.

By pressing the actuation device 4 in the pressing direction 7, it is unlocked. Optionally, it is additionally pressed slightly in the shifting direction 5. In this unlocked position E, the actuation device 4 can shift in and opposite to the shifting direction 5.

The electrical conductor 6 is clamped in the direct plug-in compression spring terminal 1 in that the actuation device 4 is displaced opposite to the shifting direction 5 during which the clamping spring 3 is relaxed so that it supports the shifting of the actuation device 4 with its clamping force.

The clamping spring 3 relaxes until the clamping arm 31 rests on the electrical conductor 6. It then lies with an open end 310 on the electrical conductor 6. In this clamping state K, the clamping arm 31 presses the electrical conductor 6 with its clamping force against the bus bar 2.

The activation device 4 is prevented from falling out of the second introduction opening 14 by the bent contour or projection 43, which comes to rest on the counter-contour or lip 17 of the direct plug-in compression spring terminal 1. The counter-contour 17 is arranged on the wall 16 dividing the conductor introduction opening 13 and the second introduction opening 14.

When the activation device 4 is shifted out of the secured position G or the unlocked position E into the shifting direction 5, it makes contact with the clamping arm 31 and moves it from the clamping state K to the open state O. At this time, the counter-catch 15 engages with the catch portion 41 so that the activation device 4 again engages in the catch position R. The electrical conductor 6 can then be removed again from the direct plug-in compression spring terminal 1.

What is claimed is:

1. A plug-in terminal for connecting an electrical conductor with a bus bar, comprising (a) a housing containing a first opening for receiving the electrical conductor and a second opening, said first opening having a longitudinal axis and said housing including a projection adjacent to said second opening and a contact portion on a side opposite said projection;

(b) a clamping spring pivotally connected with said housing and including a clamping arm which pivots about a pivot axis in a clamping direction from an open condition in which the electrical conductor can be inserted into said housing via said opening and a clamping condition wherein said clamping arm biases the conductor against the bus bar; and (c) an actuator arranged in said housing second opening and including a catch portion, said actuator being operable in a shifting direction parallel to said longitudinal axis to pivot said clamping arm from said clamping condition to said open condition, said actuator engaging said housing contact portion when said clamping arm is in said open condition, said clamping arm biasing said actuator at an angle greater than 0° relative to said shifting direction when said clamping arm is in said open condition with said housing projection engaging said actuator catch portion to lock said actuator in a locked position.

2. A plug-in terminal as defined in claim 1, wherein said actuator is pivotable about said housing contact portion in an unlocking direction transverse to said shifting direction to release said housing projection from said actuator catch portion.

3. A plug-in terminal as defined in claim 2, wherein said clamping arm pivots from said open condition to said clamping condition by displacing said actuator in a direction opposite to said shifting direction.

4. A plug-in terminal as defined in claim 1, wherein said actuator includes a projection at its lower end and said housing includes a lip below said contact portion, said actuator projection engaging said housing lip during displacement of said actuator in a direction opposite to said shifting direction in order to limit displacement of said actuator in said direction opposition to said shifting direction.

5. A plug-in terminal as defined in claim 1, wherein said housing second opening has a diameter greater than a diameter of said actuator.

* * * * *